US011848124B2

(12) United States Patent
Kondo et al.

(10) Patent No.: US 11,848,124 B2
(45) Date of Patent: Dec. 19, 2023

(54) CONDUCTOR FOR BUSBAR ELECTRIC WIRE, AND BUSBAR ELECTRIC WIRE

(71) Applicant: YAZAKI CORPORATION, Tokyo (JP)

(72) Inventors: Hiroki Kondo, Susono (JP); Mizuki Shirai, Susono (JP); Takeshi Kamata, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/744,625

(22) Filed: May 14, 2022

(65) Prior Publication Data

US 2022/0399139 A1 Dec. 15, 2022

(30) Foreign Application Priority Data

Jun. 15, 2021 (JP) ..... 2021-099476

(51) Int. Cl.
*H01B 7/02* (2006.01)
*H01B 7/08* (2006.01)
*H01B 7/00* (2006.01)

(52) U.S. Cl.
CPC ..... *H01B 7/08* (2013.01); *H01B 7/0081* (2013.01); *H01B 7/02* (2013.01)

(58) Field of Classification Search
CPC ... H01B 7/02; H01B 7/04; H01B 7/06; H01B 7/08; H01B 7/0081; H01B 7/0018; H01B 7/00
USPC ..... 174/36, 70 B, 90 B, 112, 117 R, 117 F, 174/117 FF
See application file for complete search history.

(56) References Cited

U.S. PATENT DOCUMENTS

2013/0089996 A1* 4/2013 Zhao ..... H01R 11/288 439/212
2014/0000927 A1* 1/2014 Hashimoto ..... H01B 13/06 174/68.2
2014/0360756 A1 12/2014 Honda et al.
2020/0035407 A1 1/2020 Urushihara et al.
2022/0324400 A1* 10/2022 Hernandez Covarrubias ..... H01R 25/145

FOREIGN PATENT DOCUMENTS

JP 2014-238927 A 12/2014
JP 2016-76316 A 5/2016
JP 2018-160317 A 10/2018
JP 2020-077498 A * 5/2020 ..... H01B 7/04
JP 2020-77498 A 5/2020

* cited by examiner

*Primary Examiner* — William H. Mayo, III
(74) *Attorney, Agent, or Firm* — KENEALY VAIDYA LLP

(57) ABSTRACT

A conductor for a busbar electric wire can include a conductive plate material having a substantially rectangular cross-sectional shape and an opening formed on one side in a width direction orthogonal to a longitudinal direction of the plate material. The width direction can correspond to a planar direction of the plate material. A busbar electric wire can include the conductor and an insulating sheath that covers the plate material.

6 Claims, 4 Drawing Sheets

CONDUCTOR FOR BUSBAR ELECTRIC WIRE, AND BUSBAR ELECTRIC WIRE

This application is based on and claims priority under 35 USC 119 from Japanese Patent Application No. 2021-099476 filed on Jun. 15, 2021, the contents of which are incorporated herein by reference.

TECHNICAL FIELD

The present disclosure relates to a conductor for busbar electric wire and a busbar electric wire.

BACKGROUND ART

In related art, from the viewpoint of saving space at the time of wiring to a vehicle or the like, a busbar electric wire using a flat conductor having a rectangular (flat) cross section has been proposed (see JP2014-238927A, JP2016-076316A, and JP2018-160317A).

Herein the busbar electric wires described in JP2014-238927A, JP2016-076316A, and JP2018-160317A need to be bent in a planar direction of the flat conductor in order to be wired in accordance with a vehicle shape or the like. At the time of bending in the planar direction, a bending jig having a predetermined bending R is in contact with the inner side of bending. For this reason, in the busbar electric wires described in JP2014-238927A, JP2016-076316A, and JP2018-160317A, at the time of bending in the planar direction, metal of an inner portion of the flat conductor tends to be compressed, which increases a plate thickness of the inner portion and leads to occurrence of cracks. Occurrence of cracks unexpectedly changes the electrical characteristics, which causes a problem that the specification cannot be satisfied.

SUMMARY OF INVENTION

The present disclosure provides a conductor for busbar electric wire and a busbar electric wire capable of reducing a possibility of cracks occurring in a bending in a planar direction.

According to an illustrative aspect of the present disclosure, a conductor for busbar electric wire configured by a conductive plate material having a substantially rectangular cross-sectional shape, includes: an opening formed on one side in a width direction orthogonal to a longitudinal direction of the plate material, the width direction corresponding to a planar direction of the plate material.

According to the present disclosure, since the one side in the planar direction of the plate material is formed with the opening, when the plate material is bent such that the one side becomes the inner side, the opening is filled by the compression of the inner side, which prevents an increase in the plate thickness. Therefore, it is possible to prevent an increase in the plate thickness on the inner side of bending at the time of bending in the planar direction, thereby reducing the possibility of cracking.

DESCRIPTION OF EMBODIMENTS

Hereinafter, the present disclosure will be described in accordance with a preferred embodiment. The present disclosure is not limited to the embodiment to be described below, and can be changed as appropriate without departing from the gist of the present disclosure. In addition, although some configurations are not illustrated or described in the embodiment to be described below, it goes without saying that a known or well-known technique is applied as appropriate to details of an omitted technique within a range in which no contradiction occurs to contents to be described below.

Figure 1:
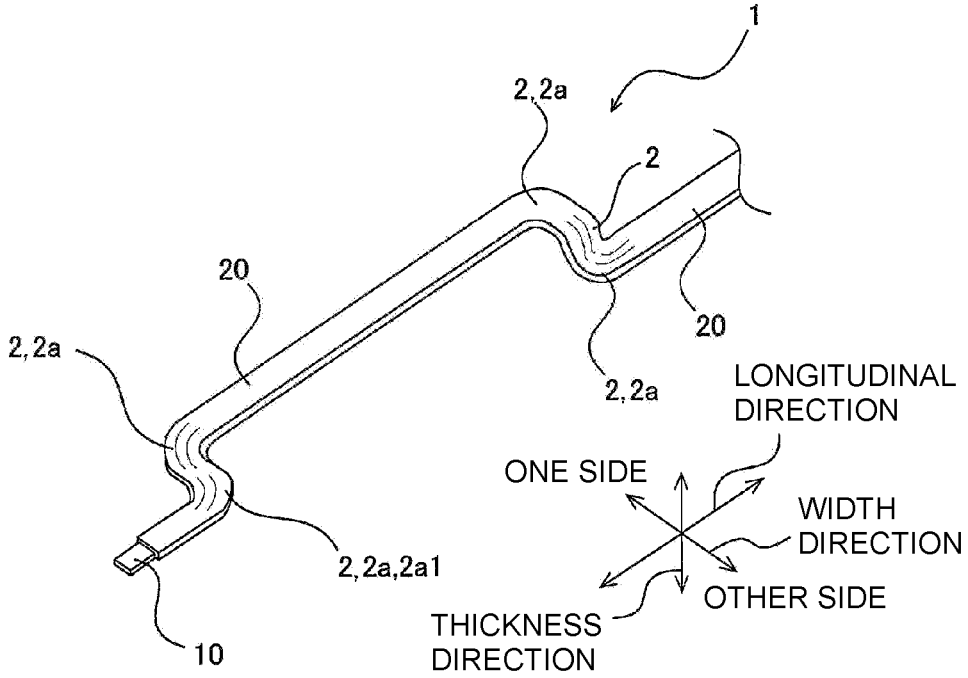
FIG. 1 is a first perspective view illustrating a busbar electric wire according to an embodiment of the present disclosure.
Figure 2:
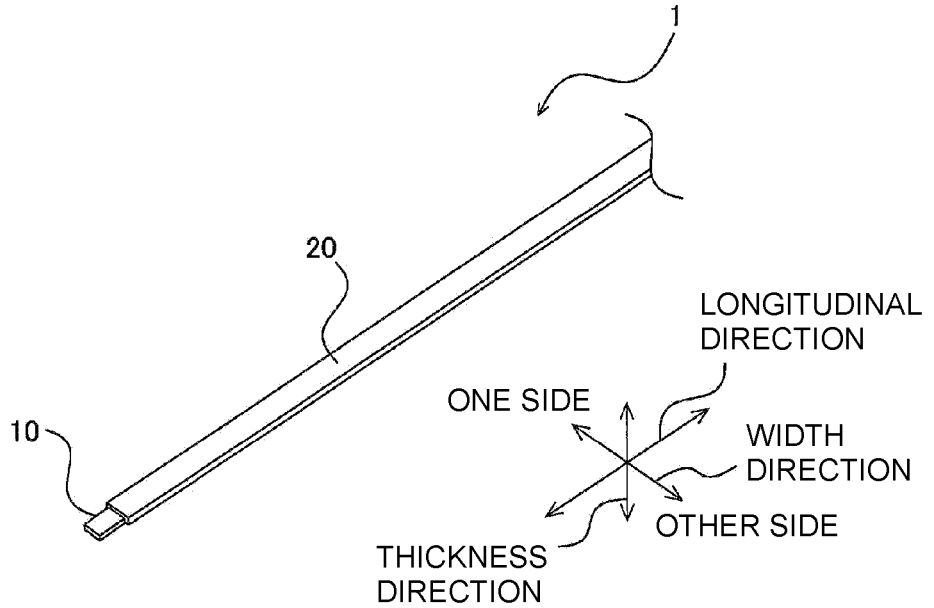
FIG. 2 is a second perspective view illustrating the busbar electric wire according to the embodiment of the present disclosure.

FIG. 1 is a first perspective view illustrating a busbar electric wire according to an embodiment of the present disclosure, and FIG. 2 is a second perspective view illustrating the busbar electric wire according to the embodiment of the present disclosure. As illustrated in FIGS. 1 and 2, a busbar electric wire 1 according to the present embodiment is wired in a vehicle as, for example, a wire harness, and includes a flat conductor (conductor for busbar electric wire) 10 and an insulating sheath 20.

The flat conductor 10 is configured with, for example, a conductive plate material of aluminum, inevitable impurities, and the like, and has a shape of a cross section orthogonal to a longitudinal direction (as for a cross section passing through a void 11*b* to be described later, a shape of the cross section excluding the void 11*b*) that is substantially rectangular (including not only a complete rectangular shape but also a rectangular shape having a slightly rounded corner). In the present embodiment, the flat conductor 10 is formed of a single plate, but is not limited thereto, and a plurality of flat conductors 10 may be laminated in a thickness direction. In addition, a plurality of layers may be stacked in a width direction as long as the layers form a rectangular shape that is longer in the width direction than in the thickness direction.

The insulating sheath 20 is configured with an insulator that covers an outer periphery of the flat conductor 10. The insulating sheath 20 is made of, for example, polypropylene (PP), polyethylene (PE), polyvinyl chloride (PVC), or the like.

In the present embodiment, the flat conductor 10 has a predetermined plate thickness and a predetermined plate width, so as to ensure no less than a predetermined cross-sectional area (for example, a cross-sectional area of 15 $mm^2$ or more (a total cross-sectional area as for a flat conductor 10 constituted by a plurality of plates or the like instead of a single plate)), so that the flat conductor 10 can be used as a power supply wire.

Such a busbar electric wire 1 (flat conductor 10) according to the present embodiment is manufactured so as to have a substantially linear shape as illustrated in FIG. 2, and is bent to include a bent portion 2 illustrated in FIG. 1 when wired in a vehicle, so as to match a shape of the vehicle. A bent portion 2*a* as a part of the bent portion 2 is bent in a planar direction (in-plane direction) of the flat conductor 10.

Figure 3:
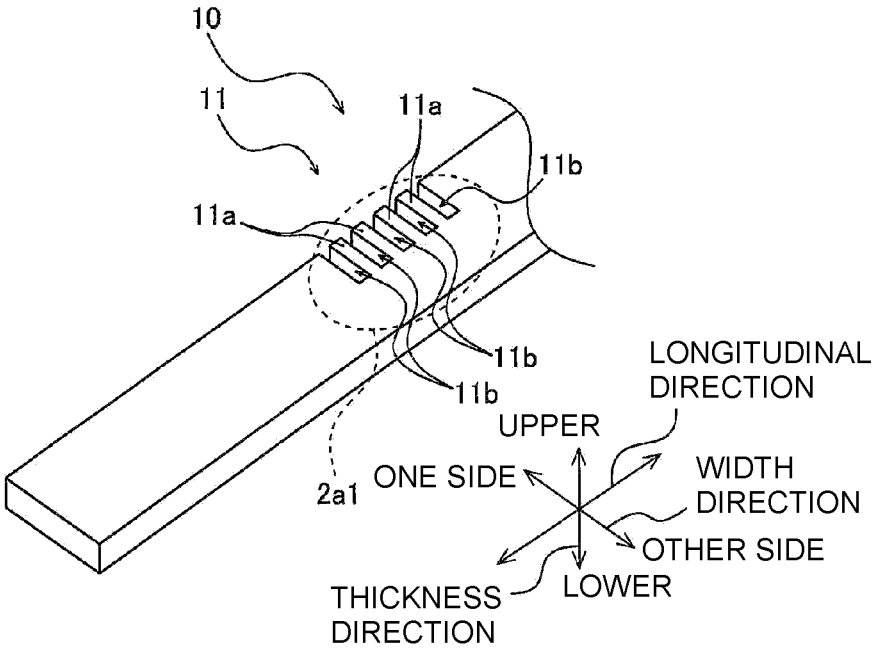
FIG. 3 is a perspective view illustrating a flat conductor of the busbar electric wire illustrated in FIG. 2.
Figure 4:
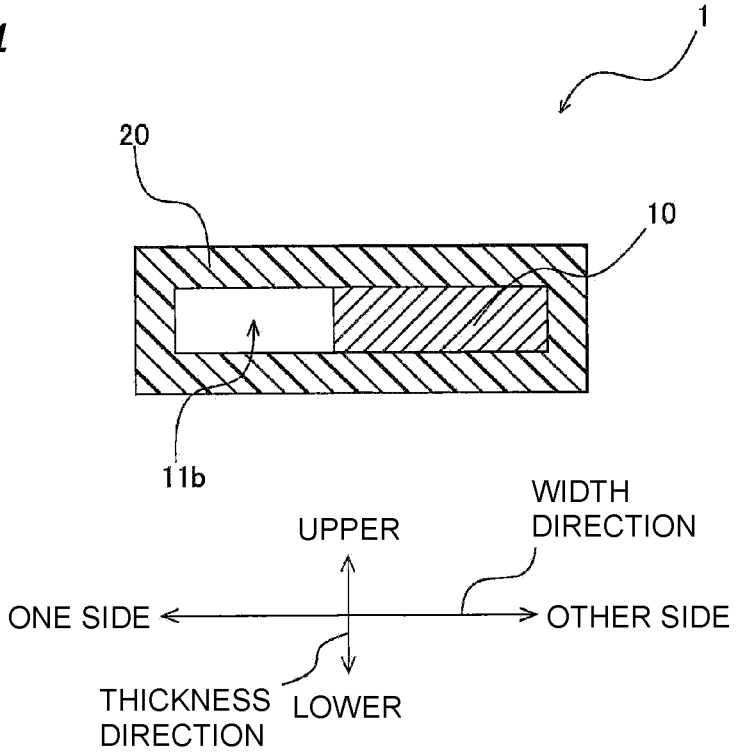
FIG. 4 is a cross-sectional view of the busbar electric wire illustrated in FIG. 2.

FIG. 3 is a perspective view illustrating the flat conductor 10 of the busbar electric wire 1 illustrated in FIG. 2, and FIG. 4 is a cross-sectional view of the busbar electric wire 1 illustrated in FIG. 2. The flat conductor 10 illustrated in FIG. 3 illustrates the vicinity of a specific bent portion 2*a*1 bent to one side in the planar direction as illustrated in FIG. 1, and FIG. 4 illustrates a cross section passing through a portion denoted by reference numeral 11*b* illustrated in FIG. 3.

As illustrated in FIG. 3, the flat conductor 10 has a comb tooth portion 11 at a position corresponding to the specific bent portion 2*a*1. The comb tooth portion 11 is formed on one side in the planar direction of the flat conductor 10 (hereinafter, one side when the flat conductor 10 is divided into two in the width direction orthogonal to the longitudinal direction is referred to as one side, and the other side is referred to as the other side), and has an uneven shape. More specifically, the comb tooth portion 11 has a plurality of plate portions 11*a* extending toward the one side, and a plurality of voids (openings) 11*b* are formed by hollowing out positions on both sides (both sides along the longitudinal direction of the flat conductor 10) of the plate portions 11*a*. In the present embodiment, a center of gravity of the voids 11*b* is located on the one side of the flat conductor 10 in a plan view of the flat conductor 10.

In the busbar electric wire 1 according to the present embodiment, the insulating sheath 20 is provided on the flat conductor 10 by tube extrusion or the like. As illustrated in FIG. 4, the insulating sheath 20 is not filled in the voids 11*b* formed in the flat conductor 10. In the example illustrated in FIG. 4, the voids 11*b* are not filled with the insulating sheath 20 at all. However, as long as the voids 11*b* are at least partially not filled and an action to be described later can be obtained, the voids 11*b* may also be filled with a small amount of the insulating sheath 20. Specifically, at least 20% or more of the entire voids 11*b* is not filled, preferably 50% or more are not filled, and more preferably 80% or more of the entire voids 11*b* is not filled.

Although only the vicinity of the specific bent portion 2*a*1 is illustrated in FIG. 3, the other bent portions 2*a* illustrated in FIG. 1 are similarly formed with the comb tooth portion 11 illustrated in FIG. 3 on the inner side of bending.

Figure 5:
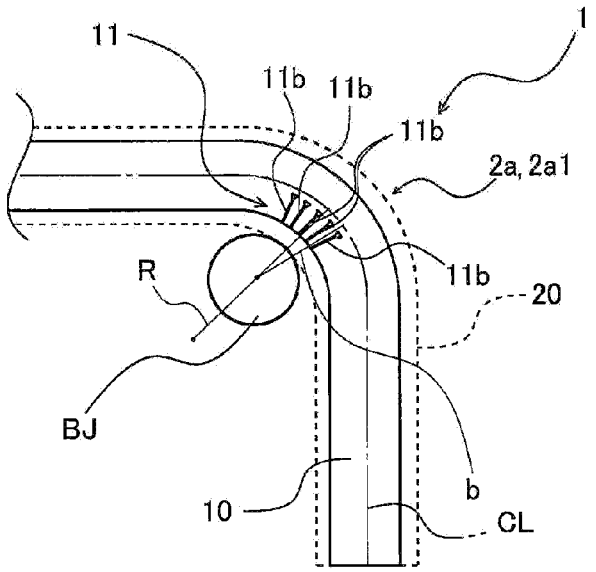
FIG. 5 is a top view for illustrating an operation of the busbar electric wire according to the embodiment.

Next, the operation of the busbar electric wire 1 according to the present embodiment will be described. FIG. 5 is a top view for illustrating the operation of the busbar electric wire 1 according to the embodiment. In FIG. 5, the flat conductor 10 and a bending jig BJ are indicated by solid lines, and the insulating sheath 20 is indicated by broken lines.

When the linear busbar electric wire 1 illustrated in FIG. 2 is formed with the bent portions 2*a* (specific bent portion 2*a*1) as illustrated in FIG. 1, the bending jig BJ is disposed on the one side (inner side of bending) in the planar direction. A worker bends the busbar electric wire 1 along the bending jig BJ to form the bent portions 2*a* each having a predetermined bending R.

Here, as illustrated in FIG. 5, when the busbar electric wire 1 is bent in the planar direction, the inner side of bending of the flat conductor 10 is in a compressed state. In addition, due to the presence of the bending jig BJ, the metal constituting the flat conductor 10 cannot escape to the inner side, and the plate thickness of the flat conductor 10 tends to increase. Cracks may be generated due to the increase in the plate thickness.

In the present embodiment, however, the comb tooth portion 11 is formed on the one side (inner side of bending) in the planar direction of the flat conductor 10. Further, the insulating sheath 20 is not filled in at least a part of the voids 11*b* of the comb tooth portion 11. Therefore, the shape of the flat conductor 10 is changed so as to fill the voids 11*b* of the comb tooth portion 11 when the flat conductor 10 is bent in the planar direction, thereby preventing the increase in the plate thickness.

In particular, not only the increase in the plate thickness is prevented, but also the plate portions 11*a* are brought into contact with each other so as to fill the voids 11*b*, so that a current can flow through the plurality of plate portions 11*a*, which can be utilized to maintain the electrical characteristics.

In the example illustrated in FIG. 5, the plurality of plate portions 11*a* (see FIG. 3) are in contact with each other, but the cross-sectional area of the flat conductor 10 and the like may also be determined to ensure electrical characteristics on the assumption that the plurality of plate portions 11*a* are not in contact with each other.

Here, as illustrated in FIG. 5, the busbar electric wire 1 is bent to have the bending radius R by using the bending jig BJ. At this time, a distance b from a bending center CL of the busbar electric wire 1 to a center of the bending jig BJ is preferably 2.44 mm or more. As a result of intensive studies conducted by the inventors of the present disclosure, measurement was performed while changing a length and the like of the voids 11*b* to various values, and it has been found that when the distance b from the bending center CL to the center of the bending jig BJ is 2.44 mm or more, for example, cracks did not occur even at R5 in an object in which cracks occurred at R15 in a case without the comb tooth portion 11, which means that the crack reduction effect is dramatically improved. Therefore, it can be said that the distance b is preferably 2.44 mm or more.

The plate portions 11*a* are preferably thin, and preferably have, for example, a thickness along the longitudinal direction of the flat conductor 10 of 7.5 mm or less. This is because that thin plate portions 11*a* are less likely to increase the thickness of the flat conductor 10 upon the compression at the time of bending.

A distance between the voids 11*b* (a distance between the plate portions 11*a*) is preferably long, and is preferably, for example, 1.0 mm or more. This is because that a long distance between the voids 11*b* is less likely to increase the thickness of the flat conductor 10 upon the compression at the time of bending.

In this way, according to the flat conductor 10 of the present embodiment, since the one side in the width direction of the plate material is formed with the voids 11*b*, when the plate material is bent such that the one side becomes the inner side, the voids 11*b* are filled by the compression of the inner side, which prevents an increase in the plate thickness. Therefore, it is possible to prevent an increase in the plate thickness on the inner side of bending at the time of bending in the planar direction, thereby reducing the possibility of cracking.

According to the busbar electric wire 1 of the present embodiment, since the insulating sheath 20 is not filled in at least a part of the voids 11*b*, it is possible to prevent the insulating sheath 20 from being completely filled in the voids 11*b*, thereby preventing the function of filling the voids 11*b* from being difficult to achieve when the busbar electric wire 1 is bent in the planar direction.

Since the busbar electric wire 1 is bent along the plate surface at the portion where the voids 11*b* are formed, such that the one side of busbar electric wire 1 the is on the inner side, it is possible to provide a busbar electric wire 1 that can prevent the occurrence of cracks while realizing the predetermined bending R.

Although the present disclosure has been described based on the embodiment, the present disclosure is not limited to the embodiment described above. The present disclosure may be modified as appropriate without departing from the gist of the present disclosure, or may be combined with known or well-known techniques as appropriate if possible.

Figure 6:
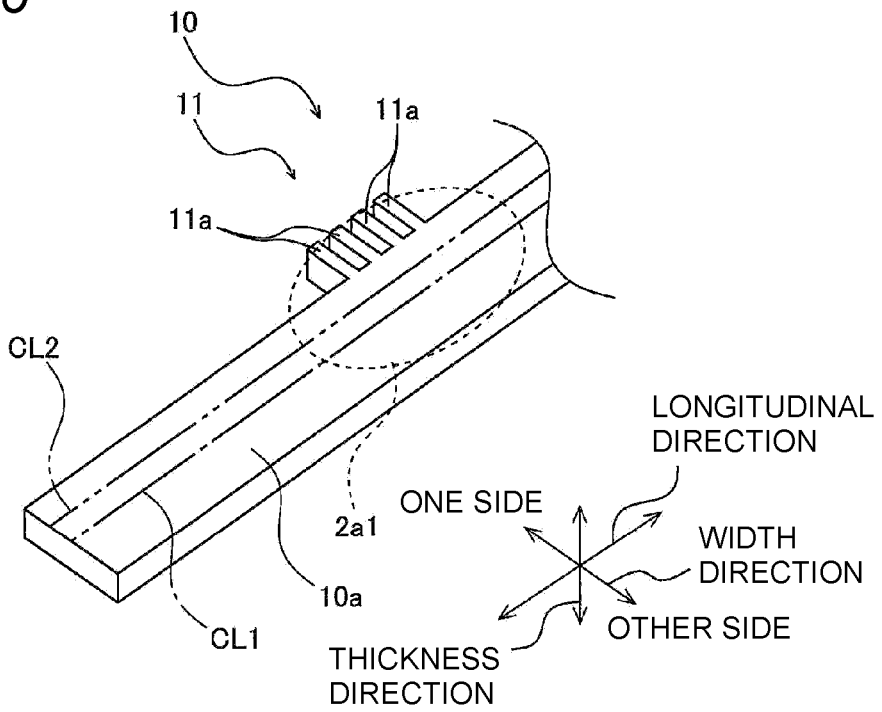
FIG. 6 is a configuration diagram illustrating a flat conductor according to Modification 1.
Figure 7:
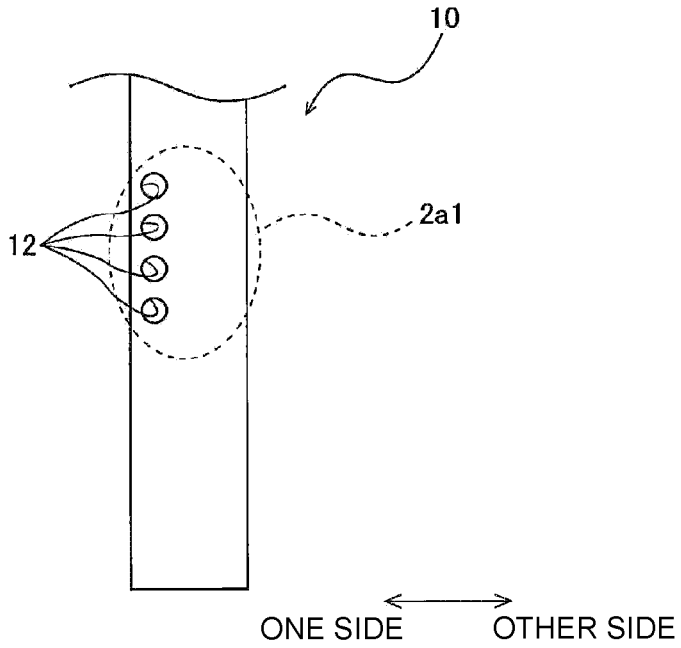
FIG. 7 is a configuration diagram illustrating a flat conductor according to Modification 2.
Figure 8:
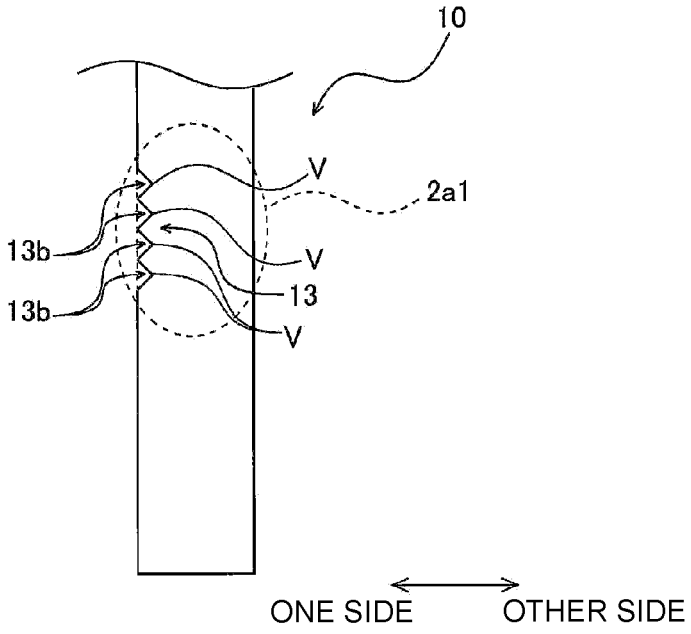
FIG. 8 is a configuration diagram illustrating a flat conductor according to Modification 3.

FIGS. 6 to 8 are configuration diagrams illustrating the flat conductor 10 according to Modifications 1 to 3. As illustrated in FIG. 6, the flat conductor 10 according to Modification 1 includes a comb tooth portion 11 that protrudes from one side of a body portion 10*a* extending at the same width in the longitudinal direction.

Here, in a case without including the protruding comb tooth portion 11, the bending center CL1 using the bending jig BJ (see FIG. 5) is a line indicated by a one-dot chain line in FIG. 6. That is, the bending center CL1 is a width center line of the body portion 10*a*. On the other hand, in a portion including the protruding comb tooth portion 11, the bending center CL2 using the bending jig BJ is a line indicated by a two-dot chain line in FIG. 6. That is, in a portion formed with the protruding comb tooth portion 11, the bending center CL2 is displaced from the width center line of the body portion 10*a*. As a result, it is possible to obtain the same function as the function described in the specific bent portion 2*a*1 with reference to FIG. 5, and it is possible to reduce the possibility of crack occurrence.

The bent portion 2*a* (specific bent portion 2*a*1) is not limited to the case where the comb tooth portion 11 is formed, and may be formed with through holes (opening) 12 penetrating the flat conductor 10 in the thickness direction as illustrated in FIG. 7. In this configuration, a center of gravity of the through holes 12 is located on the one side of the flat conductor 10, and when the flat conductor 10 is bent to the one side in the planar direction, the shape of the flat conductor 10 is changed so as to fill the through holes 12, whereby it is possible to reduce the possibility of crack occurrence.

Further, without being limited to the comb tooth portion 11 having the voids 11*b* that are rectangular in a plan view, a V-shaped notch 13 has voids (openings) 13*b* that are triangular in a plan view as illustrated in FIG. 8. In this configuration as well, a center of gravity of the voids 13*b* is located on the one side of the flat conductor 10, and when the flat conductor 10 is bent to the one side in the planar direction, the shape of the flat conductor 10 is changed so as to fill the voids 13*b*, whereby it is possible to reduce the possibility of crack occurrence. In addition, when each void 13*b* has a shape having one vertex V on the other side as in the V-shaped notch 13 illustrated in FIG. 8, the void 13*b* can be easily filled at the time of bending to the one side, and electrical characteristics can be easily realized after filling the void 13*b*.

Comparing the comb tooth portion 11, the through holes 12, and the V-shaped notch portion 13, it is preferable to adopt the comb tooth portion 11 and the V-shaped notch portion 13 rather than the through holes 12. Here, the comb tooth portion 11 and the V-shaped notch 13 have a shape opened to the one side, whereas the through holes 12 are not opened to the one side. Therefore, at the time of bending, an end surface on the one side is compressed, and the plate thickness is likely to increase. However, the plate thickness is less likely to increase in the case of a shape opened to the one side, such as the comb tooth portion 11 and the V-shaped notch 13. Therefore, it is preferable to adopt the comb tooth portion 11 and the V-shaped notch portion 13 rather than the through holes 12.

Comparing the comb tooth portion 11 and the V-shaped notch portion 13, it is preferable to adopt the comb tooth portion 11 rather than the V-shaped notch portion 13. This is because the V-shaped notch portion 13 has a shape having pointed tips on the one side, and thus may be deformed at the time of bending using the bending jig BJ. Such deformation may disable the originally assumed crack prevention effect. On the other hand, in the case of the comb tooth portion 11, since the tips on the one side are flat surfaces, the shape thereof cannot be easily changed by the bending jig BJ. Therefore, it is preferable to adopt the comb tooth portion 11 rather than the V-shaped notch portion 13.

In the above description, the voids 11*b*, 13*b* and the through holes 12 penetrate in the thickness direction of the flat conductor 10, but are not particularly limited to penetrating. For example, a recess that has a bottom without penetrating in the thickness direction may be adopted as well. As a matter of course, a penetrating configuration is preferred for being more likely to obtain the effect of filling the voids 11*b*, 13*b*, and the like than a recess.

According to a first aspect of the present disclosure, a conductor for busbar electric wire (10) configured by a conductive plate material having a substantially rectangular cross-sectional shape, includes: an opening (11*b*, 12, 13*b*) formed on one side in a width direction orthogonal to a longitudinal direction of the plate material, the width direction corresponding to a planar direction of the plate material.

According to a second aspect of the present disclosure, a busbar electric wire (1) may include: the conductor for busbar electric wire (10) according to the first aspect; and an insulating sheath (20) that is an insulator covering the conductor for busbar electric wire (10). At least a part of the opening (11*b*, 12, 13*b*) may have a non-filled portion in which the insulating sheath (20) is not filled.

According to a third aspect of the present disclosure, the busbar electric wire (1) may further include: a bent portion (2, 2*a*, 2*a*1) formed by bending, towards the one side along the planar direction of the plate material, a portion (2, 2*a*, 2*a*1) having the opening (11*b*, 12, 13*b*) on the one side that is an inner side of bending.

What is claimed is:

1. A conductor for busbar electric wire comprising:

a conductive plate material having a substantially rectangular cross-sectional shape; and an opening formed only on one side of the plate material in a width direction orthogonal to a longitudinal direction of the plate material, the width direction corresponding to a planar direction of the plate material, and the opening passes through the plate material in a thickness direction of the plate material, wherein the plate material has a center line that extends in the longitudinal direction and bisects the plate material in the width direction, and the opening extends from the one side in the width direction and stops in the width direction at a location on the plate material that is between the one end and the center line.

2. A busbar electric wire comprising:

the conductor for busbar electric wire according to claim 1; and an insulating sheath that is an insulator covering the conductor for busbar electric wire, wherein at least a part of the opening has a non-filled portion in which the insulating sheath is not filled.

3. The busbar electric wire according to claim 2, further comprising:

a bent portion formed by bending, towards the one side along the planar direction of the plate material, a portion having the opening on the one side that is an inner side of bending.

4. The busbar electric wire according to claim 3, wherein the plate material has a top surface, a bottom surface that is opposite to the top surface, a first side surface that extends from and is connected to each of the top surface and the bottom surface, and a second side surface that is opposite to the first side surface in the width direction, the second side surface extends from and is connected to each of the top surface and the bottom surface, the opening extends through each of the top surface, the bottom surface, and the first side surface, and the opening is spaced away from the second side surface.

5. The busbar electric wire according to claim 4, wherein the top surface and the bottom surface are flat surfaces, the first side surface is on an inner side of the bent portion and the second side surface is on an outer side of the bent portion.

6. A conductor for busbar electric wire, comprising:

a conductive plate material having a substantially rectangular cross-sectional shape;

a plurality of openings formed only on one side of the plate material in a width direction orthogonal to a longitudinal direction of the plate material, the width direction corresponding to a planar direction of the plate material, wherein the plate material includes a plurality of plate portions that are separated from each other by the openings such that a respective one of the plate portions is located between a respective pair of the openings, the plate portions contact each other when the plate material is formed with a bent portion that includes the plate portions, wherein the plate material has a center line that extends in the longitudinal direction and bisects the plate material in the width direction, and each of the openings extends from the one side in the width direction and stops in the width direction at a respective location on the plate material that is between the one end and the center line.

* * * * *